United States Patent [19]

Bernardi

[11] 4,151,923

[45] May 1, 1979

[54] THERMALLY INSULATED PRE-CHILL DRINKING GLASS

[76] Inventor: Dario Bernardi, via Mazzini 5, Cattolica (Forli), Italy, 20123

[21] Appl. No.: 664,112

[22] Filed: Mar. 5, 1976

Related U.S. Application Data

[63] Continuation-in-part of Ser. No. 428,579, Dec. 26, 1973, abandoned.

[30] Foreign Application Priority Data

Dec. 29, 1972 [IT] Italy ..... 44050 A/72

[51] Int. Cl.[2] ..... B65D 15/02

[52] U.S. Cl. ..... 215/13 R

[58] Field of Search ..... 215/13 R; 62/530, 457

[56] References Cited

U.S. PATENT DOCUMENTS

| | | | |
|---|---|---|---|
| 1,968,263 | 7/1934 | Reuther | 215/13 R |
| 2,169,426 | 8/1939 | Morton | 215/13 R |
| 2,526,165 | 10/1950 | Smith | 62/530 X |
| 2,622,415 | 12/1952 | Landers | 62/530 X |
| 2,715,326 | 8/1955 | Gits | 215/13 R |
| 2,725,733 | 12/1955 | Davis | 215/13 R |
| 2,863,585 | 12/1958 | Meshberg | 215/13 R X |
| 2,959,941 | 11/1960 | McDonald | 62/457 X |
| 3,258,147 | 6/1966 | Rownd | 215/13 R |

*Primary Examiner*—Donald F. Norton

*Attorney, Agent, or Firm*—Guido Modiano; Albert Josif

[57] ABSTRACT

A thermally insulated pre-chill drinking glass comprising an inner cup having a predetermined high thermal mass and of a compact vitreous material, an outer cup adapted to receive and enclose the inner cup, and a pedestal for supporting the glass onto a surface. The inner and outer cups having mating conformations near the top for holding together the two cups while leaving an interspace therebetween which is effective to ensure a good thermal insulation for a minimum bulk.

1 Claim, 5 Drawing Figures

THERMALLY INSULATED PRE-CHILL DRINKING GLASS

CROSS-REFERENCE TO RELATED APPLICATIONS

This is a continuation-in-part application of my parent patent application Ser. No. 428,579, filed Dec. 26, 1973 now abandoned.

BACKGROUND OF THE INVENTION

This invention relates to drinking glasses provided with means for thermally insulating their contents and capable of being chilled, more specifically suitable for being cooled down to at least −20° C. or less.

There exist several reasons, in other words the applications, why the need is felt for pre-chill drinking glasses and with good thermal insulation: it is desired, in some instances, to prevent the formation of condensation on the walls whenever a cold drink happens to be contained in such glasses; it is desired not to warm up the contents of a glass held in the hand; it is desired to preserve contents at a given temperature, suitable for drinking it; or, furthermore, it is desired to cool the poured drink, by using the pre-chilling of the glass, so as to avoid dilution of the drink contents through the addition of ice by mentioning just a few examples.

The glass of the invention is of a type that may be pre-chilled in order to cool a drink and preserve it cold for a given time.

The advantages which are inherent in the procedure of chilling the glass for certain drinks which are recommended or preferred for use at a given temperatures ranging from 12°–14° C. for wines such as Bordeaux, to 4° C. for some dry spirits, such as whisky, have already been fully realized since long. These reside, in addition to the fact that the drink remains undiluted, also in the capability presented by a chilled glass of cooling its contents down to a predetermined temperature whereat such contents is then maintained for a while, whereas, by using ice, the drink would continue to cool down, far below the desired temperature, as well as to dilute.

As early as 1947, E. L. Smith in his U.S. Pat. No. 2,526,165, and as 1948, T. P. Landers in his U.S. Pat. No. 2,622,415, proposed separately glasses which were suitable for pre-chilling, and thus for transferring a given amount of calories from the drinks poured thereinto. Both inventions provide glasses having walls formed with a hollow space wherein a liquid, e.g. water, is sealed which freezes at a moderately low temperature and is capable of yielding and absorbing appreciable amounts of heat during the phase conversion step.

The above cited inventions, which met with a good success, have, however two noteworthy practical drawbacks. First is in fact, the very presence of the phase-changing liquid, which constitutes their most advantageous thermal feature, with a high thermal capacity in a limited space, creates technological problems in that the change of phase implies substantial volume changes, and stresses that tax heavily the vitreous material typical brittleness, thereby their construction becomes difficult and costly to put into practice, if predetermined thermal expansions and thermal gradients are to be achieved. The second main drawback comes from the lack of a suitable thermal insulation from the ambient in such glasses. This results in a disagreable cold feeling being transmitted through the hand while the glass is held in the user's hand, and in the subtraction of part of the cold intended for chilling the drink, thereby the cooling effectiveness of such a container is reduced.

Indeed, glasses are known which have been provided with an improved thermal insulation of the contents from the surrounding space. The invention by B. P. Murphy (U.S. Pat. No. 2,832,493 issued in 1956) provides a duplex or dual type of drinking glass comprised of two containers, adapted for insertion one within the other and forming a hollow space therebetween. The object specified for this combination was to prevent condensation along the glass walls and avoid the cooling of the user's hand holding the glass.

Back in 1936, W. A. Morton disclosed in his U.S. Pat. No. 2,169,426 a glass comprising two cups, to be placed one within the other with a gap therebetween: however the object here was primarily of an aesthetic nature, since the two cups were respectively of a vitreous and metal material, playing with the color combinations thereof. The outer cup also performed a protective function, being preferably metallic, but provided no thermal insulation, since the inner cup extended for a considerable length not screened.

Furthermore, hot drink glass cups, such as coffee cups, provided with a vacuum interspace, "thermos" bottle fashion, effective to keep a drink hot for a considerably long time, are well known and currently being used for bar serving, for example, company offices.

Still another vessel, thermally insulated by an interspace also applicable to a drinking glass configuration, is disclosed in the U.S. Pat. No. 3,221,915 issued in 1962 to W. J. Gort; therein the inner wall is made of glass or a vitreous matter, and an outer one is made of plastics; the interspace is filled with a foamed or expanded resin effective to provide thermal insulation and shock resisting properties.

It might appear obviously expedient to combine a drinking glass having a two-phase coolant of the type described above with a thermal insulation according to either one of the cited methods. However the problem is not so simple, and although the need for such a drinking glass is definitely felt, it has not been as yet fulfilled. In fact, the addition of a second interspace would make the glass, which already comprises a hollow interspace, exceedingly thick and difficult to manufacture. Thus different approaches have been considered in other directions and for special objects.

H. G. Zimmerman proposes, in his U.S. Pat. No. 2,876,634 of 1954, a coffee cup, easily adaptable to produce a drinking glass, containing a "thermodynamic" liquid which changes phase when placed into a refrigerator, under the effect of a hot drink, such as coffee, to stop its cooling at a desired temperature.

Similarly to Zimmerman's teachings, but in an even simpler manner, G. P. Todd in his U.S. Pat. No. 3,766,975 provides water in the interspace of a coffee cup, not freezable, effective to rapidly cool its coffee contents based upon the thermal masses and specific heat ratios involved, and keep it for a few minutes within a desired temperature range, thanks to the increased overall thermal mass.

Thus, the general problem has been left largely unsolved of providing a drinking glass capable of cooling a drink poured thereinto.

SUMMARY OF THE INVENTION

Accordingly, it is a general object of this invention to obviate the cited drawbacks in the prior art pre-chill drinking glasses.

It is a particular object of the invention to provide a pre-chill drinking glass having a calibrated thermal mass such as to ensure, following the pre-chilling in a standard freezer, a predetermined cooling effect on an amount of drinking liquid.

It is another particular object of the invention to provide a good thermal insulation for such a glass in order to maintain said drinking liquid cold over an extended period of time, even when the glass is held in the hand, and avoid the inducing of any disagreable cold sensation through the hand.

These and other objects, such as will become apparent hereinafter, are achieved by a thermally insulated pre-chill glass according to the invention which comprises: an inner cup having a predetermined high thermal mass and of a compact vitreous material, an outer cup adapted to receive and enclose said inner cup, a pedestal means for resting said glass onto a surface, and a connecting means for holding together said two cups leaving an interspace therebetween which is effective to ensure a good thermal insulation with a minimum bulk.

According to a further aspect of the invention, the connecting means for the two cups comprises a spring catch means with capabilities for manual insertion and withdrawal of the inner cup into and out of the outer one, in order to provide the faculty of chilling the inner cup alone.

BRIEF DESCRIPTION OF THE DRAWINGS

The features and advantages of the invention will be more apparent from the ensuing detailed description of some preferred embodiments thereof, provided by way of example and not of limitation, with reference to the accompanying drawings. Throughout the drawings, the figures show elevations and half-sections of the invention, namely.

DESCRIPTION OF PREFERRED EMBODIMENTS

Figure 1:
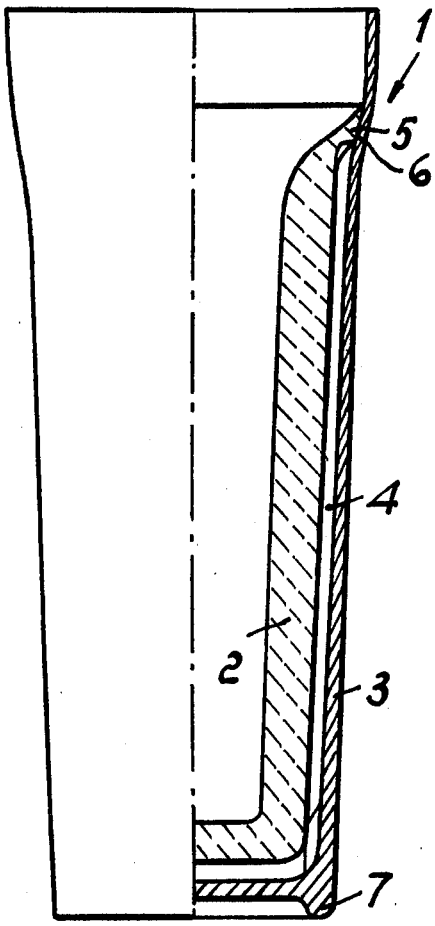
FIG. 1 shows a drinking glass.

In the drawings, all similar parts, or different parts inequivocably performing the same functions, are identified with the same reference numerals. The reference numeral 1 identifies generally a glass incorporating the invention teachings. A glass 1, according to the invention, comprises essentially an inner cup member 2 and an outer cup member 3. The cup member 2, hereinafter termed "the inner cup" for brevity, is the container designed to receive the drink poured into the glass, while the other cup member 3, or outer cup, forms a second wall of the glass. The two cups, joined together to form a drinking glass, define between them an interspace 4 which divides and insulates thermally the inner cup both along the sides and bottom thereof. The connecting means for holding the inner cup 2 together with the outer one 3 is represented in the embodiment of FIG. 1 by a peripheral edge or rim 5 projecting outwardly from the inner cup 2 body and contacting a progressively narrowing portion 6 of the outer cup 3 inner surface. Said interconnection or coupling is preferably made permanent and tight, either by hot molding or hot thermosetting adhesive, such as a thermosetting epoxy resin. The inner cup remains thus suspended from its upper rim 5, and insulated all around the rest of its body, the interspace being filled with dry air in order to prevent condensation, or a vacuum is provided therein by a known technique.

The inner cup 2 is made of a vitreous material for drinking glasses, selected from those exhibiting higher specific heat characteristics and higher specific gravities, such as to secure the higher possible thermal capacity per unit of volume, it being required, moreover, that the vitreous material possesses good thermal conductivity properties and a good resistance to thermal shocks, and has a thickness and volume such that the overall thermal capacity of the cup relates to the volume contained by the cup in its container role, or more specifically to the volumetric capacity of that cup intended for filling with a drink, in a definite ratio. In other words, and consequently, after selecting the material in conformity with the requirements stated above, in the example of glass geometry shown, for instance, in FIG. 1, the thickness of the cup 2 has to bear a certain ratio to the average diameter of the containing cavity of that cup, and such a ratio will be a function of the selected material properties as well as of the expected operative conditions according to the formula, $V = KC$, where C is the volume of the drink contained in the cup, V is the volume of the vitreous material in all the walls of the inner cup, and K is a coefficient which depends on the cited parameters, linearly on the temperatures of the drink poured in and of the cooled drink, and on the freezer wherein the glass has been chilled. Practical values of K, and hence of said thickness dimension, will be provided in the examples which follow.

The outer cup 3 has an axial length which is greater than that of the inner cup 2 and projects upwardly by a portion suitable for contacting the drinker's lips, and intended to avoid for the drinker the need to contact a very thick portion of the glass, generally providing an unpleasant feeling. The outer cup 3 is of thin glass wall design, no further limitations being imposed on its structure. As visible in FIG. 1, the inner cup member 2 has a thickness which is substantially greater than that of the outer cup member. For resting the drinking glass onto a surface, such as a pedestal means, the outer cup includes, in the embodiment of FIG. 1, a base 7 formed by a downward projecting peripheral edge.

Figure 2:
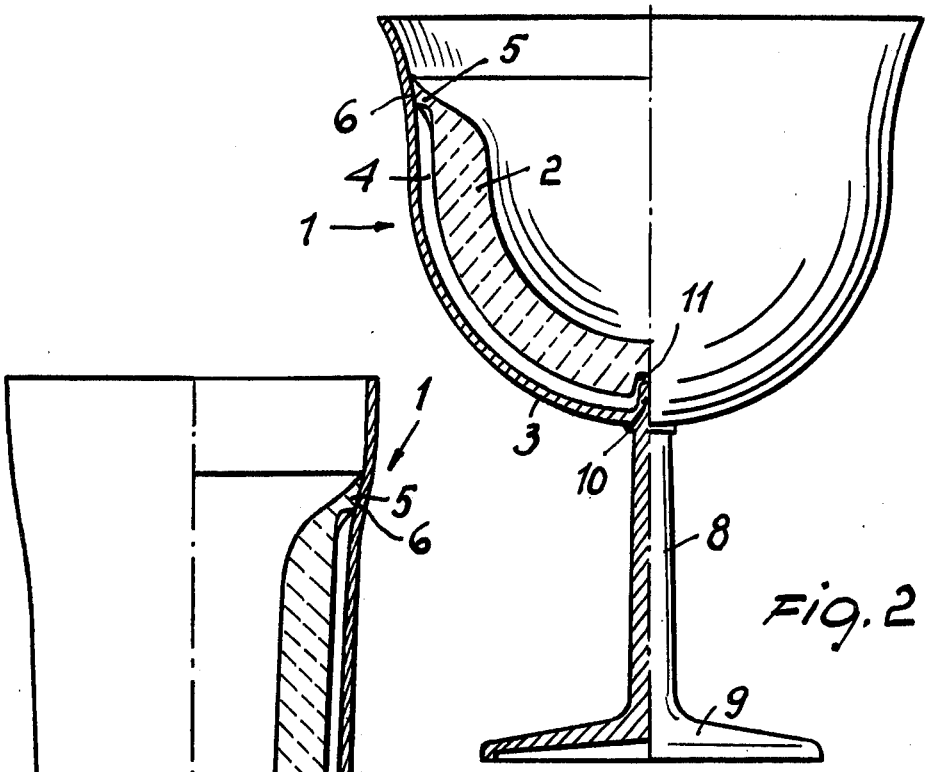
FIG. 2 shows a coffee type of drinking glass.

The drinking glass in FIG. 2 differs from the one just described only for the geometry of its shape, and not in the way the invention is implemented. The pedestal means is in this instance a stem or leg 8 with base 9, which are quite common for this type of drinking glass or goblet. The stem is integral with the outer cup 3 which, at the bond line with the stem, is provided with a raised portion 10. The recess 11 provided in the inner cup to accommodate the raised portion, has the sole function of creating an available space and does not act as a guide member or member for fastening mechanically the two cups together.

Figure 4:
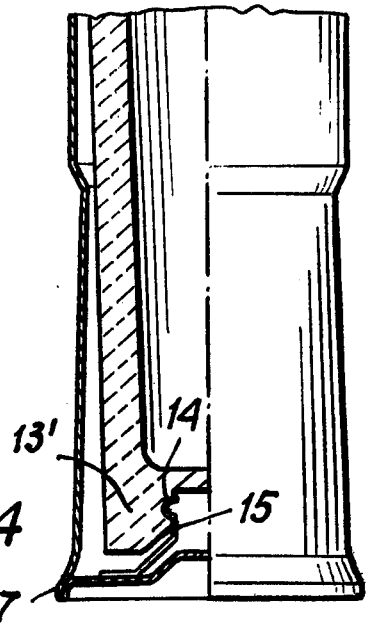
FIG. 4 is a modification of the embodiment of FIG. 3.
Figure 3:
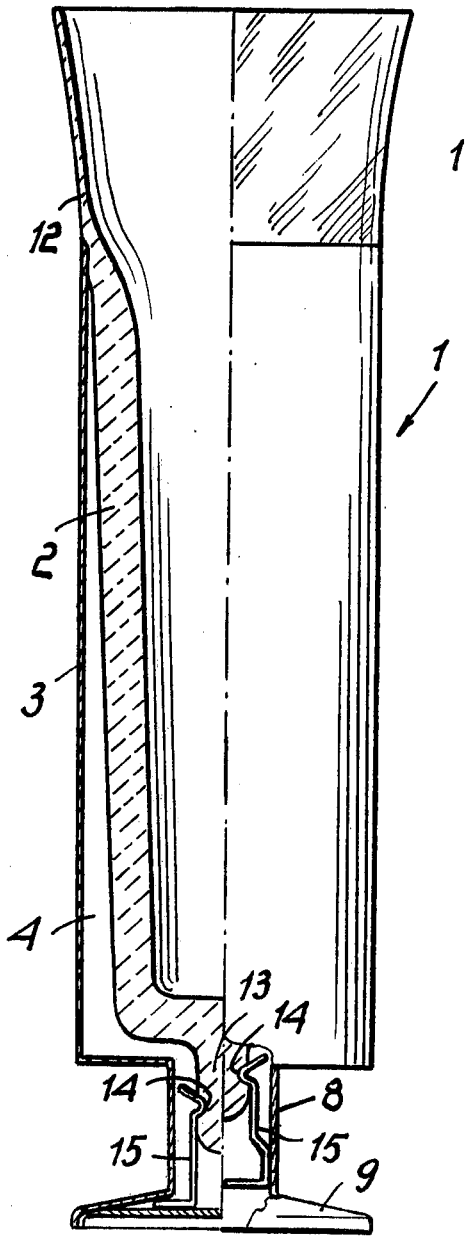
FIG. 3 shows another embodiment of a cup type of drinking glass, which can be disassembled in two discrete parts.
Figure 5:
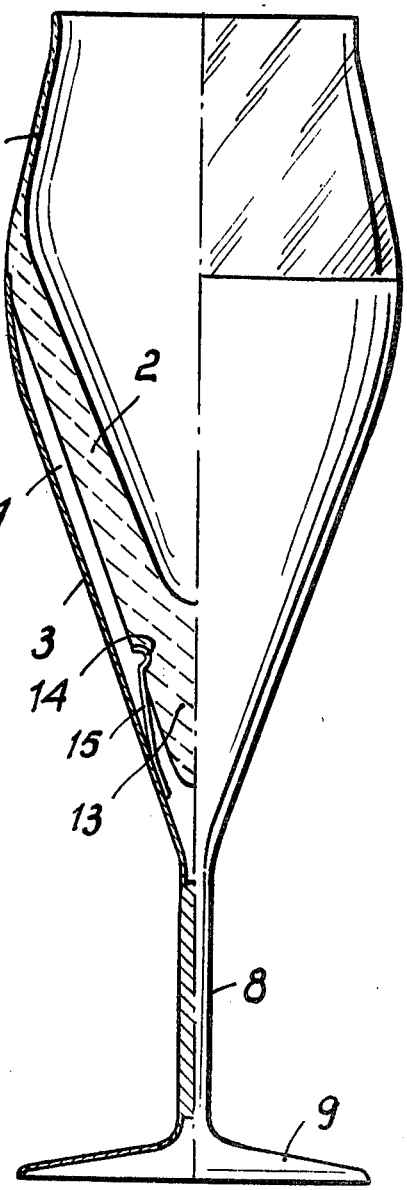
FIG. 5 is a further embodiment of the glass made of two parts.

The following drinking glasses shown in FIGS. 3–5 illustrate variations in the application of the inventive concept, which differ from the configuration common to the two glasses described above in that the two cups that make up the glass are in these embodiments separable and quickly reassembled, thereby it becomes possible to chill in the freezer only the inner cup, actually the one storing the cold, while the outer cup, acting as a liner and holding portion, remains at ambient temperature. This new approach to the problem presents two practical advantages: the inner cup, once released from the insulating outer liner, is enabled to cool to the desired temperature level in less time, say ¼ of the time, doubling the exchange surface and having the depth of extraction of the heat. In order to render this feature a practical one, i.e. one that does not require special handling but simply the insertion of one cup into the other, as required for use at a bar, the inner cup is made to project upwards above the outer one, such that it becomes possible to grasp it by that upward projecting rim, identified by 12 in the drawings.

In order to couple the two cups together elastically, since it is obviously impossible to rely on the resiliency of the vitreous material, more elaborate coupling means have been provided, wherefor FIG. 3 shows a solution, there being provided two further variations of execution of the catch mechanism. The inner cup 2 is here provided with a horn or projection 13 which extends axially downward from the bottom. Said horn is formed with a circumferential groove 14, wherein one or more metal clips 15 snap, said clips being arranged circumferentially. FIG. 3 shows, by way of example, two different clips, secured to the outer cup 3 bottom. A modified configuration for the catch mechanism appears illustrated in FIG. 4. Rather than a horn, a projecting ring 13' is provided here, and the clips engage with an inner recess formed therein. The projections 13 and 13' contribute to the thermal capacity of the inner cup. The upper rim is now only a loose fit, as permitted by the use of vitreous materials having a low thermal expansion coefficient.

The drinking glass of FIG. 5, which does not present further novel features, illustrates how the provision of two cups separated by an interspace and of a catch device permits pleasing and classic designs to be achieved for the glass, which while being functional as well as elegant enable the containment of a high thermal mass without affecting adversely the glass capacity and without increasing its bulk to an unaesthetic extent.

The examples provide technical data relating to the subject glasses.

EXAMPLE I

For a drinking glass as shown in FIG. 1 or, alternatively, in FIGS. 3 and 4, the following operative conditions were fixed.

Useful capacity (C) = 82.5 cu. cm.

Overall capacity = 125 cu. cm.

Temperature of the drink as poured in = 20° C.

Temperature at which the drink is to be cooled = 4° C.

Freezer temperature = − 20° C.

Specific heat of the drink = 1 cal./°Cg

A vitreous material was selected having a specific gravity equal to 2.25 g/cu.cm. and a specific heat of 0.2 cal./g°C. Thus, in the formula $V = KC$, $C = 82.5$ cm$^3$ and $K = 1.3$, therefore $V = 108$ cm$^3$. The above for a drinking glass with 15 cm of overall height and average inside diameter equal to 3.2 cm, having the general proportions of FIG. 1, provides a thickness of approximately 0.8 cm, which is an entirely acceptable dimension.

EXAMPLE II

A drinking glass as shown in FIG. 5 was designed in conformity with the instant invention teachings, to a useful capacity of 52 cu. centimeters and an overall capacity of 150 cu. centimeters the other conditions being the same as under Example I.

A vitreous material thermal mass is obtained equal approximately to 67 cu. centimeters which, when considering the substantial drop-like mass at the bottom, provides an average thickness of 0.75 centimeters.

By using instead a vitreous material having specific gravity equal to 3 g/cm$^3$, and specific heat equal to 0.17 cal./g°C., the vitreous material volume could be reduced to about 53 cm$^3$, and the average thickness reduced to 0.70 cm.

The examples demonstrate that the solution proposed herein is valid, not only theoretically and technologically, but also from a practical point of view in that it results in dimensions for the drinking glass which are quite acceptable in normal usage.

The examples and the embodiments described obviously do not exhaust the potential applications of the invention which fall within the scope and spirit of it, as defined in the appended claims.

I claim:

1. A thermally insulated pre-chill drinking glass comprising an inner cup member and an outer cup member surrounding said inner cup member, a pedestal on said outer cup member for supporting said glass onto a surface, and means for holding together said outer cup member and said inner cup member such as to define an interspace therebetween for thermal insulation, wherein said inner cup member is made of vitreous material having high specific gravity, high thermal mass and good thermal conductivity and has a thickness which is substantially greater than that of said outer cup member all along the axial direction thereof and said outer cup member has an axial length which is greater than that of said inner cup member such as to project therefrom at the top, said inner cup member further having a peripheral rim at the top and said outer cup member having a progressively narrowing portion for matingly engaging said peripheral rim and holding said inner cup member suspended inside said outer cup member.

* * * * *